United States Patent [19]

Kiuchi

[11] Patent Number: 4,718,388

[45] Date of Patent: Jan. 12, 1988

[54] METHOD OF CONTROLLING OPERATING AMOUNTS OF OPERATION CONTROL MEANS FOR AN INTERNAL COMBUSTION ENGINE

[75] Inventor: Takeo Kiuchi, Wako, Japan

[73] Assignee: Honda Giken Kogyo Kabushiki Kaisha, Tokyo, Japan

[21] Appl. No.: 917,177

[22] Filed: Oct. 9, 1986

[30] Foreign Application Priority Data

Oct. 12, 1985 [JP] Japan ..... 60-227575

[51] Int. Cl.[4] ..... F02M 51/00

[52] U.S. Cl. ..... 123/478; 123/585

[58] Field of Search ..... 123/478, 339, 492, 493, 123/585; 364/431.05; 74/859, 860

[56] References Cited

U.S. PATENT DOCUMENTS

| | | | |
|---|---|---|---|
| 4,596,164 | 6/1986 | Hajogawa et al. | 123/478 |
| 4,653,449 | 3/1987 | Kamei et al. | 123/478 |
| 4,655,186 | 4/1987 | Takoda et al. | 123/478 |
| 4,671,241 | 6/1987 | Yamato | 123/478 |

*Primary Examiner*—Raymond A. Nelli

*Attorney, Agent, or Firm*—Lyon & Lyon

[57] ABSTRACT

A method of controlling an operating amount of an operation control system for controlling the operation of an internal combustion engine wherein the operating amount is controlled on the basis of first and second desired operating amounts determined in dependence on respective first and second operating parameters indicative of engine load conditions, respectively, when the engine is operating in a predetermined low load condition, and when the engine is operating in another operating condition. When the engine has entered the predetermined low load condition from an operating condition other than the predetermined low load condition, a correction value of the operating amount is obtained on the basis of the difference between the determined first and second desired operating amounts, to correct the determined first desired operating amount. The corrected first desired operating amount is compared with the determined second desired operating amount. The desired operating amount is controlled on the basis of the determined second desired operating amount, from the time the engine has entered the predetermined low load condition to the time the corrected first desired operating amount becomes substantially equal to the determined second desired operating amount, whereas it is controlled on the basis of the corrected first desired operating amount after the corrected first desired operating amount becomes substantially equal to the determined second desired operating amount until the engine enters an operating condition other than the predetermined low load condition.

10 Claims, 7 Drawing Figures

INTERNAL COMBUSTION ENGINE
FUEL INJECTION VALVES
INPUT CIRCUIT
CPU
STORAGE MEANS
OUTPUT CIRCUIT
ECU
Ne
Tw
PBA
θTH
PA
1
2
3
4
5
6
6a
6b
7
8
8a
9
9a
9b
9c
9d
10
11
12
13
14
15

| |
|---|
| FIG. 2A |
| FIG. 2B |

| $\theta_{TH}-\theta_{IDL}$ | $K_{\theta M}$ |
|---|---|
| 0 | $K_{\theta M0}$ |
| 1 | $K_{\theta M1}$ |
| 2 | $K_{\theta M2}$ |
| 3 | $K_{\theta M3}$ |
| 4 | $K_{\theta M4}$ |
| 5 | $K_{\theta M5}$ |
| 6 | $K_{\theta M6}$ |
| 7 | $K_{\theta M7}$ |

$\theta_{TH}$ $1_{LSB}=0.0977$

METHOD OF CONTROLLING OPERATING AMOUNTS OF OPERATION CONTROL MEANS FOR AN INTERNAL COMBUSTION ENGINE

BACKGROUND OF THE INVENTION

This invention relates to a method of controlling the operating amount of an operation control means for an internal combustion engine, and more particularly to a method of this kind which is adapted to set a desired operating amount for an operation control means, which is optimal to an operating condition of the engine in a predetermined low load region, to thereby achieve smooth operation of the engine.

A method has been proposed, e.g. by Japanese Provisional Patent Publications (Kokai) Nos. 58-88436 and 53-8434, which determines a basic operating amount of operation control means for controlling the operation of the engine, such as a basic fuel injection amount to be supplied to the engine by a fuel supply quantity control system, a basic value of ignition timing to be controlled by an ignition timing control system, and a basic recirculation amount of exhaust gases to be controlled by an exhaust gas recirculation control system, in dependence on absolute pressure in the intake pipe of the engine and engine rotational speed, and corrects the basic operating amount thus determined in response to the temperature of engine cooling water, the temperature of intake air, etc., to thereby set a desired operating amount for the operation control means with accuracy.

However, with the above-mentioned conventional method of determining the desired operating amounts of the operation control means in dependence on the intake pipe absolute pressure and the engine speed (generally called "the speed density method", and hereinafter merely referred to as "the SD method"), the rate of change in intake pipe absolute pressure is small with respect to a change in engine speed when the engine is operating in a low load condition such as an idling condition. This, together with pulsation in intake pipe absolute pressure caused by suction stroke of the engine, makes it difficult to detect intake pipe absolute pressure with accuracy so that an operating amount such as a fuel supply quantity cannot be controlled to values in accordance with operating conditions of the engine with accuracy, often resulting in hunting of the engine rotation.

In view of this disadvantage, a method (hereinafter merely called "the KMe method") has been proposed, e.g. by Japanese Patent Publication (Kokoku) No. 52-6414, which is based upon the recognition that the quantity of intake air passing the throttle valve is not dependent upon pressure PBA in the intake pipe downstream of the throttle valve or pressure of the exhaust gases while the engine is operating in a particular low load condition, e.g. an idling condition, wherein the ratio (PBA/P'A) of intake pipe pressure PBA downstream of the throttle valve to intake pipe pressure PA' upstream of the throttle valve is below a critical pressure ratio (=0.528) at which the intake air forms a sonic flow, and accordingly the quantity of intake air can be determined solely in dependence on the valve opening of the throttle valve. Therefore, this proposed method detects the valve opening of the throttle valve alone to thereby detect the quantity of intake air with accuracy while the engine is operating in the abovementioned particular low load condition, and then sets the desired operating amounts of the operation control means on the basis of the detected value of the intake air quantity.

However, if, for instance, the manner of setting the fuel injection quantity is promptly switched from the SD method to the KMe method immediately when the engine enters the above particular low load condition from a condition other than the particular low load condition, an abrupt change can occur in the desired operating amounts such as the fuel injection quantity to even cause engine shock and engine stall.

In order to overcome this inconvenience, a method has been proposed by Japanese Provisional Patent Publication (Kokai) No. 60-88830 which determines a desired operating amount of the operation control means by the SD method as well as that by the KMe method, immediately after the engine enters the above particular low load condition from a condition other than the particular low load condition, and continues controlling the operating amount of the operation control means based on the desired operating amount determined by the SD method until the two desired operating amounts determined by the SD method and the KMe method become substantially equal to each other.

However, according to this proposed method the following problem arises when the control method is switched from the SD method to the KMe method: There can occur differences between the actual opening areas of a control valve which bypasses a throttle valve for controlling the amount of supplementary air to the engine, and the throttle valve and the detected opening areas of same, the differences being due to variations in operating characteristics of the sensor for detecting throttle valve opening, installation error of same, clogging of an air cleaner at an inlet of the intake pipe, etc. or possibly due to accumulation of carbon, etc. from the blow-by gases and the atmosphere on the throttle valve and the control valve. Especially, if the supplementary air quantity control valve is formed of a so-called linear solenoid type electromagnetic valve which is adapted to control its opening degree in proportion to driving current, the difference between the detected opening area and the actual opening area will be greater due to the difference between the desired valve opening based on the driving current and the actual valve opening area, i.e. characteristic error of the control valve itself. Because of this error, the desired operating amount determined by the SD method and that determined by the KMe method cannot be substantially equal to each other when the engine enters the particular low load condition, and accordingly the switching of the control method from the SD method to the KMe method cannot be effected smoothly and promptly, rendering the engine operation unstable.

SUMMARY OF THE INVENTION

It is the object of the invention to provide a method of controlling the operating amount of an operation control means for controlling an internal combustion engine, which is adapted to enable smooth and prompt switching of the method of determining the operating amount of the operation control means, when the engine enters a particular low load condition from a condition other than the particular low load condition, thereby achieving stable and smooth operation of the engine.

According to the invention, there is provided a method of controlling an operating amount of an operation control means for controlling the operation of an internal combustion engine on the basis of a first desired operating amount determined in dependence on a value of a first engine operating parameter indicative of load conditions of the engine when the engine is operating in a predetermined low load condition, and on the basis of a second desired operating amount determined in dependence on a value of a second engine operating parameter indicative of load conditions of the engine when the engine is operating in an operating condition other than the predetermined low load condition. The method is characterized by comprising the following steps: (1) when the engine has entered the predetermined low load condition from an operating condition other than the predetermined low load condition, (i) determining the difference between the first and second desired operating amounts of the operation control means, which are determined in dependence on the values of the first and second engine operating parameters, respectively, and obtaining a correction value of the operating amount of the operation control means on the basis of the determined difference, (ii) correcting the determined first desired operating amount by the correction value, (iii) comparing the corrected first desired-operating amount with the determined second desired operating amount, and (iv) determining the desired operating amount of the operation control means in dependence on the determined second desired operating amount, from the time the engine has entered the predetermined low load condition to the time the corrected first desired operating amount becomes substantially equal to the determined second desired operating amount, even while the engine is actually operating in the predetermined low load condition; (2) determining the desired operating amount of the operation control means in dependence on the first desired operating amount after the corrected first desired operating amount becomes substantially equal to the determined second desired operating amount until the engine enters an operating condition other than the predetermined low load condition; and (3) controlling the operating amount of the operation control means on the basis of the desired operating amount determined at the step (1)–(iv) or (2).

Preferably, the method includes steps of detecting an opening area of an intake passage of the engine, and detecting the rotational speed of the engine, and the first desired operating amount is determined in dependence on the detected opening area of the intake passage and the detected engine rotational speed. Also, the method includes steps of detecting pressure in an intake passage downstream of intake air quantity control means of the engine, and detecting the rotational speed of the engine, and the second desired operating amount is determined in dependence on the detected pressure in the intake passage and detected engine rotational speed.

Also preferably, the method is executed in synchronism with generation of pulses of a predetermined control signal, and includes steps of determining a provisional correction value based on the difference between the determined first and second desired operating amounts each time a pulse of the predetermined control signal is generated, calculating an average value of values of the provisional correction value thus determined, and employing the average value as the correction value obtained at the step (1)–(i).

The above and other objects, features and advantages of the invention will be more apparent from the ensuing detailed description taken in conjunction with the accompanying drawings.

DETAILED DESCRIPTION

The invention will now be described in detail with reference to the drawings showing embodiments thereof.

Figure 1:
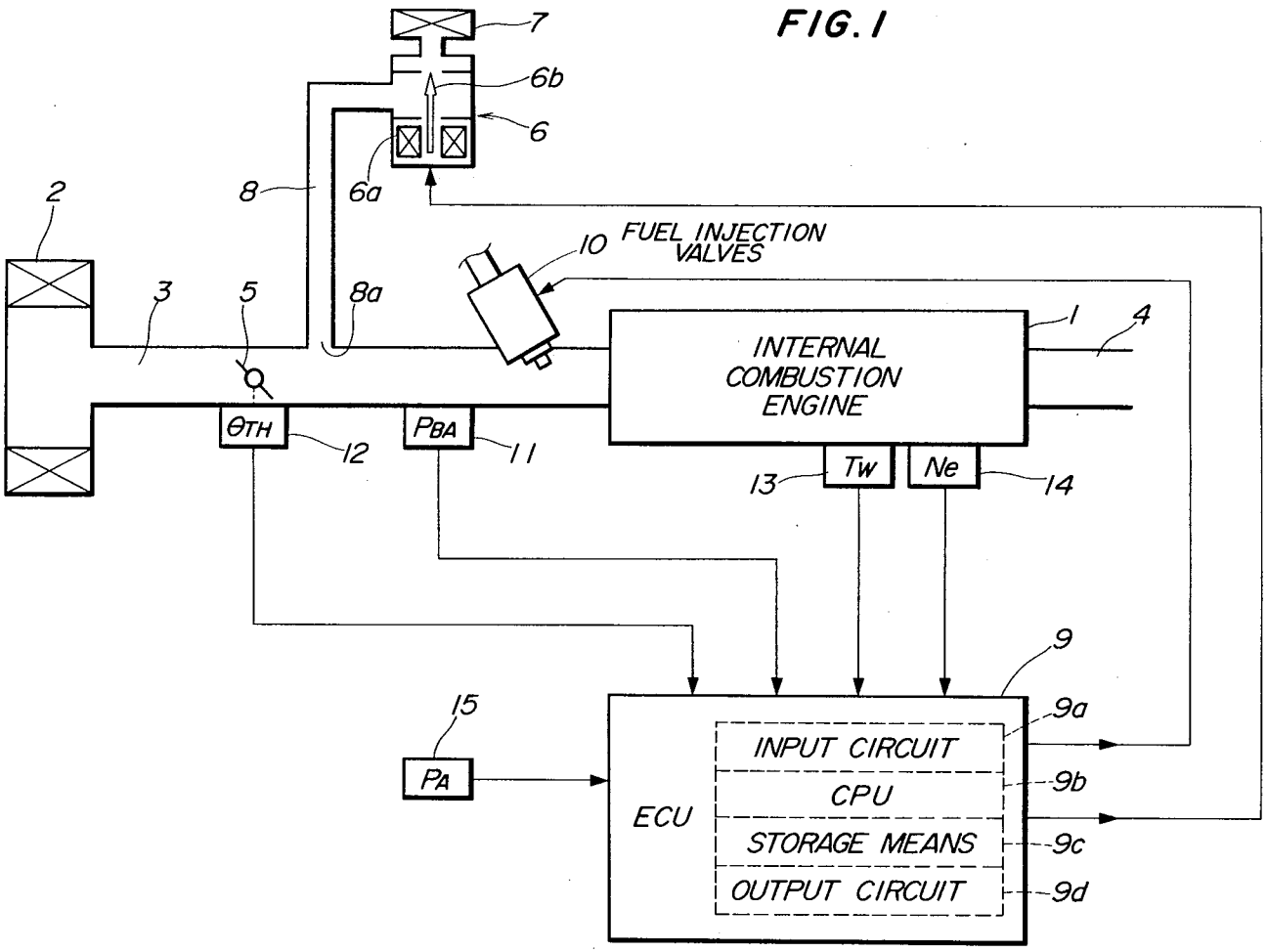
FIG. 1 is a block diagram of the whole arrangement of a fuel injection control system for internal combustion engines, to which is applied the method according to the present invention.

FIG. 1 is a block diagram of the whole arrangement of a fuel injection control system for internal combustion engines, to which is applied the method according to the present invention. In the figure, reference numeral 1 designates an internal combustion engine which may be a four-cylinder type. Connected to the engine 1 are an intake pipe 3 with its air intake end provided with an air cleaner 2 and an exhaust pipe 4. Arranged in the intake pipe 3 is a throttle valve 5. An auxiliary air passage 8 opens into the intake pipe 3 at a location downstream of the throttle valve 5 and communicates with the atmosphere. The auxiliary air passage 8 has an air cleaner 7 provided at an end thereof opening into the atmosphere. Arranged across the auxiliary air passage 8 is a supplementary air quantity control valve (hereinafter merely called "the control valve") 6 which is a so-called linear solenoid type electromagnetic valve adapted to open to degrees in proportion to driving current applied thereto, and comprises a solenoid 6*a*, and a valve body 6*b* disposed to open the auxiliary air passage 8 to degrees corresponding to the driving current energizing the solenoid 6*a*, the solenoid 6*a* being electrically connected to an electronic control unit (hereinafter abbreviated-as "the ECU") 9.

Fuel injection valves 10 and an intake pipe absolute pressure (PBA) sensor 16 are arranged in the intake pipe 3 at locations between the engine 1 and the open end 8*a* of the auxiliary air passage 8. The fuel injection valves 10 are connected to a fuel pump, not shown, and also electrically connected to the ECU 9, while the absolute pressure (PBA) sensor 11 is electrically connected to the ECU 9. A throttle valve opening ($\theta$TH) sensor 12 is connected to the throttle valve 5, and an engine coolant temperature (TW) sensor 13 is mounted on the cylinder block of the engine 1 for detecting the engine coolant or cooling water temperature as an engine temperature. These sensors 12 and 13 are also electrically connected to the ECU 9.

An engine speed (Ne) sensor 14 is disposed around a camshaft, not shown, of the engine 1 or a crankshaft, not shown, of same and adapted to generate a pulse as a top-dead-center (TDC) signal at each of predetermined crank angles of the crankshaft each time the crankshaft rotates through 180 degrees, i.e. at a crank angle position before a predetermined crank angle with respect to the top dead center (TDC) at the start of suction stroke of each cylinder, the generated TDC signal pulses being supplied to the ECU 9.

Also electrically connected to the ECU 9 is an atmospheric pressure (PA) sensor 15 for detecting atmospheric pressure.

The ECU 9 comprises an input circuit 9*a* having functions such as waveform shaping and voltage level shifting for input signals from various sensors as aforementioned and converting the level shifted analog signals into digital signals, a central processing unit (hereinafter called "the CPU") 9*b*, a storage means 9*c* for storing such items as control programs executed by the CPU 9*b* and results of calculations executed by the CPU 9*b*, and an output circuit 9*d* for supplying driving signals to the fuel injection valves 10 and the control valve 6.

The operation of the fuel injection control system constructed as above will now be described:

When the ECU 9 is supplied with respective engine operating parameter signals outputted by the throttle valve opening sensor 12, the absolute pressure sensor 11, the engine coolant temperature sensor 13, the Ne sensor, and the atmospheric pressure sensor 15. Then the ECU 9 determines based on these parameter signals whether or not the engine is operating in an operating condition wherein supplementary air should be supplied to the engine. If the engine is operating in such an operating condition, then the ECU 9 sets a target engine idling speed and, in response to the difference between the target engine idling speed and the actual engine speed, calculates a control amount command value ICMD for the control valve 6 in such a manner that the resulting value of ICMD corresponds to an amount of supplementary air minimizing the difference between the target engine idling speed and the actual engine speed, and supplies a dfiving signal representing the calculated value of ICMD to the control valve 6.

The solenoid 6*a* of the control valve 6 is disposed to displace the valve body 6*b* by an amount proportional to a change in the driving current supplied from the ECU 9 to thereby control the valve opening area to a value corresponding to the driving current, so that a desired amount of supplementary air corresponding to the controlled valve opening area is supplied to the engine 1 via the auxiliary air passage 8 and the intake pipe 3.

When the driving current energizing the solenoid 6*a* of the control valve 6 is increased, the valve body 6*b* is displaced downward, as viewed in FIG. 1, whereby the amount of supplementary air is increased to thereby increase supply of the air/fuel mixture to the engine 1, which results in increased engine output, and accordingly higher engine speed. On the other hand, when the driving current energizing the solenoid 6*a* is decreased, the supply of the air/fuel mixture is decreased to cause a reduction in engine speed. Thus, it is possible to maintain the engine idling speed at a target value by controlling the amount of supplementary air, i.e. by controlling the amount of lift of the valve body 6*b* of the control valve 6 (lift value) in response to the driving current energizing the solenoid 6*a*.

On the other hand, the ECU 9 also operates on values of the aforementioned various engine operating parameter signals and in synchronism with generation of pulses of the TDC signal to calculate the fuel injection period TOUT for the fuel injection valves 10 by the use of the following equation:

$$TOUT = Ti \times K1 + K2 \ldots \quad (2)$$

where Ti represents a basic fuel injection period, which is determined according to the aforementioned SD method or the KMe method, depending upon whether or not the engine is operating in an operating region wherein a predetermined idling condition is fulfilled, as hereinafter described in detail.

In the above equation, K1 and K2 represent correction coefficients or correction variables which are calculated on the basis of values of engine operating parameter signals supplied from the aforementioned various sensors such as the throttle valve opening ($\theta$TH) sensor 17, the atmospheric pressure (PA) sensor 23, the intake air temperature (TA) sensor 24, and the engine coolant temperature (TW) sensor 13. For instance, the correction coefficient K1 is calculated by the use of the following equation:

$$K1 = KPA \times KTW \times KWOT \ldots \quad (2)$$

where KPA represents an atmospheric pressure-dependent correction coefficient which is determined by the use of respective predetermined equations selectively applied in response to the method to be applied, i.e. the SD method or the KMe method, so as to set the coefficient KPA at a value most appropriate to the SD method or the KMe method, as hereinafter described in detail. KTW represents a coefficient for increasing the fuel supply quantity, which has its value determined in dependence on the engine coolant temperature TW sensed by the engine coolant temperature sensor 13, and KWOT a mixture-enriching coefficient applicable at wide-open-throttle operation of the engine and having a constant value.

The ECU 9 supplies the fuel injection valves 10 with driving signals corresponding to the fuel injection period TOUT calculated as above, to open the same valves.

Figure 2A:
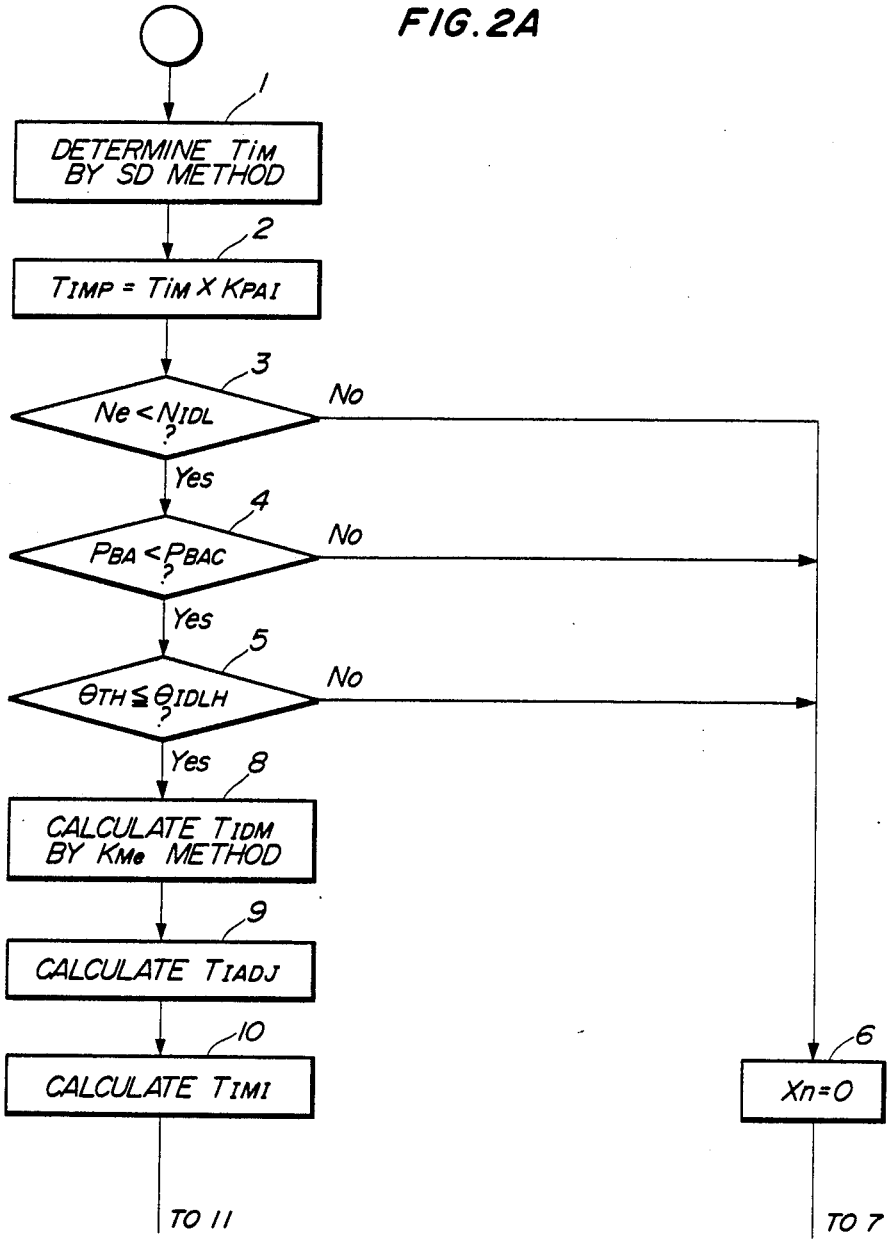
FIG. 2*a* and 2*b* are a flowchart of a program executed within an electronic control unit (ECU) 9 in FIG. 1 for calculating fuel injection period TOUT.
Figure 2:
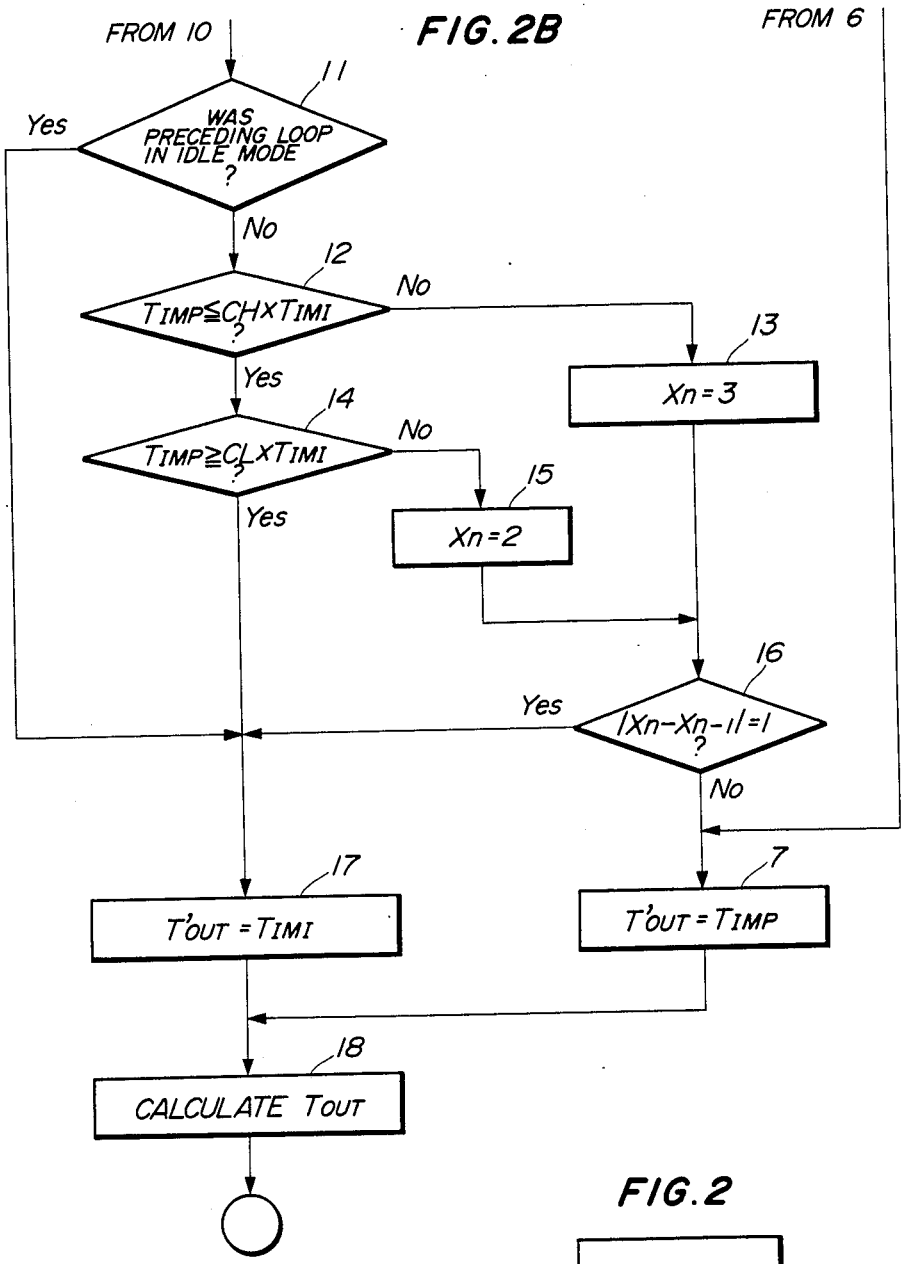

FIG. 2 shows a flowchart of a program for calculating the valve opening period TOUT of the fuel injection valves 10, which is executed within the CPU 9*b* of the ECU 9 in FIG. 1 in synchronism with generation of pulses of the TDC signal.

First, at step 1 in FIG. 2, a basic fuel injection period TiM is determined according to the SD method. More particularly, the determination of the basic fuel injection period TiM by the SD method is carried out by reading a TiM value corresponding to detected values of the intake pipe absolute pressure PBA and the engine speed Ne, from a basic fuel injection period map stored in the storage means 9*c* of the ECU 9 in FIG. 1. Then, at step 2 a value TIMP is obtained by correcting the value TiM obtained at step 1 with the atmospheric pressure-dependent correction coefficient KPA of the equation (2) by means of the following equation:

$$TIMP = TiM \times KPA1 \ldots \quad (3)$$

where KPA1 is an atmospheric pressure-dependent correction coefficient KPA applicable to the SD method and is given by the following equation, as disclosed in Japanese Provisional Patent Publication (Kokai) No. 58-85337:

$$KPA1 = \frac{1 - (1/\epsilon)(PA/PBA)^{1/\kappa}}{1 - (1/\epsilon)(PA0/PBA)^{1/\kappa}} \quad (4)$$

where PA represents actual atmospheric pressure (absolute pressure), PA0 standard atmospheric pressure, $\epsilon$ the compression ratio, and $\kappa$ the ratio of specific heat of air, respectively. The equation (4) for calculating the atmospheric pressure-dependent correction coefficient KPA1 value is based upon the recognitions that the quantity of air being sucked into the engine per suction cycle of same can be theoretically determined from the intake pipe absolute pressure PBA and the absolute pressure in the exhaust pipe which is almost equal to atmospheric pressure PA, and that to maintain the air/fuel ratio of the mixture supplied to the engine at a constant value the fuel supply quantity should be varied at a rate equal to the ratio of the intake air quantity at the actual atmospheric pressure PA to the intake air quantity at the standard atmospheric pressure PA0.

According to the equation (4), when the relationship PA<PA0 stands, the value of the atmospheric pressure-dependent coefficient KPA1 is larger than 1.0. So long as the intake pipe absolute pressure PBA remains constant, the quantity of intake air sucked into the engine becomes larger at a high altitude where the atmospheric pressure PA is lower than the standard atmospheric pressure PA0, than at a lowland. Therefore, if the engine is supplied with a fuel quantity determined as a function of the intake pipe absolute pressure PBA and the engine rotational speed Ne in a low atmospheric pressure condition such as at high altitudes, it can result in a lean air/fuel mixture. However such leaning of the mixture can be avoided by employing the above fuel increasing coefficient KPA1.

Reverting to FIG. 2, steps 3 through 5 are executed to determine whether or not the aforementioned predetermined idling condition of the engine is fulfilled. At step 3, a determination is made as to whether or not the engine rotational speed Ne is below a predetermined value NIDL (e.g. 1000 rpm). If the determination provides a negative answer (No), it is regarded that the predetermined idling condition is not fulfilled, and the program jumps to steps 6 and 7, hereinafter referred to. If the answer to the question of step 3 is Yes, the program proceeds to step 4 wherein it is determined whether or not the intake pipe absolute pressure PBA is on the lower engine load side with respect to a predetermined reference value PBAC, that is, whether or not the former is lower than the latter. This predetermined reference pressure value PBAC is set at such a value as to determine whether or not the ratio (PBA/PA') of the absolute pressure PBA in the intake pipe 3 downstream of the throttle valve 5 to the absolute pressure PA' in the intake pipe upstream of the throttle valve 5 is lower than a critical pressure ratio (=0.528) at which the flow velocity of intake air passing the throttle valve 5 is equal to the velocity of sound. The reference pressure value PBAC is given by the following equation:

$$PBAC = PA' \times (\text{critical pressure ratio}) \quad (5)$$

$$= PA' \times [2/(\kappa + 1)]^{\frac{\kappa}{\kappa-1}} = 0.528 \times PA$$

where $\kappa$ represents the ratio of specific heat of air ($\kappa$=1.4). Since the absolute pressure PA' in the intake pipe 3 upstream of the throttle valve 5 is approximate or substantially equal to the atmospheric pressure PA sensed by the atmospheric pressure sensor 15 in FIG. 1, the relationship of the above equation (5) can stand.

If the answer to the question of step 4 is No, it is regarded that the predetermined idling condition is not fulfilled, and the program proceeds to steps 6 and 7, whereas if the answer is Yes, step 5 is executed. In step 5, a determination is made as to whether or not the valve opening $\theta$TH of the throttle valve 5 is smaller than a predetermined value $\theta$IDLH. This determination is necessary for the following reason: In the event that the engine operating condition shifts from an idling condition wherein the throttle valve 5 is almost closed to an accelerating condition wherein the throttle valve is suddenly opened from the almost closed position, if this transition to the accelerating condition is detected solely from changes in the engine rotational speed and the intake pipe absolute pressure as in the aforementioned steps 3 and 4, there is a delay in the detection due to the response lag of the absolute pressure sensor 11. Therefore, a change in the valve opening of the throttle valve 5 is utilized for quick detection of such accelerating condition. If the engine is thus determined to have entered an accelerating condition, a required quantity of fuel should be calculated according to the SD method for supply to the engine.

If the answer to the question of step 5 is No, it is regarded that the predetermined idling condition is not satisfied, and then steps 6 and 7 are executed, while if the answer is Yes, step 8 is executed.

In step 6 which is executed when the predetermined idling condition is not fulfilled, the value of a control variable Xn, hereinafter referred to, is set to zero, which has been obtained in the present loop of execution of the program. Then, in step 7, a fuel injection period T'OUT is set to the value of TIMP obtained in step 2.

Figures 3, 4:
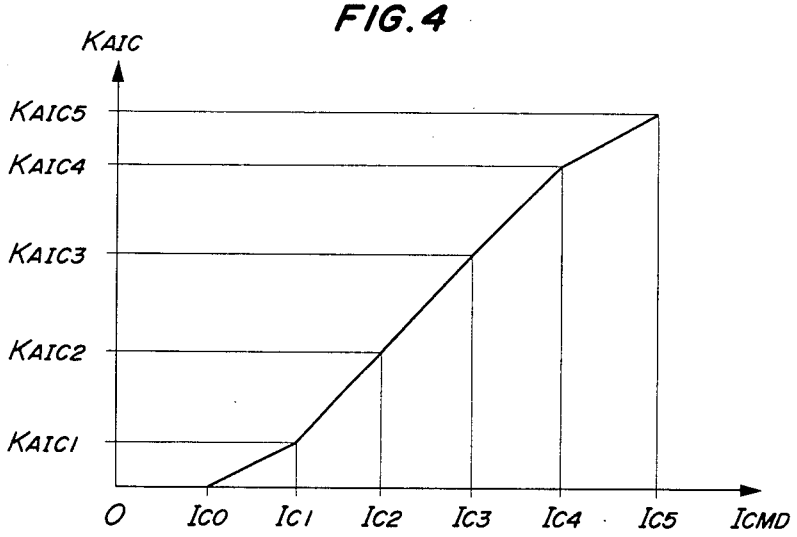
FIG. 3 is a view showing a map of the relationship between the opening area K$\theta$M of a throttle valve in FIG. 1 and the detected value of the throttle valve opening $\theta$TH.
FIG. 4 is a graph showing the relationship between the value of driving current (ICMD) supplied to a supplementary air quantity control valve 6 in FIG. 1 and the opening area KAIC of same.

If the answers to the questions of steps 3 through 5 are all Yes, then it is regarded that the predetermined idling condition is satisfied, and a basic fuel injection period TIDM is determined according to the KMe method at step 8 by means of the following equation:

$$TIDM = (K\theta M + KAIC) \times Me \ldots \quad (6)$$

where K$\theta$M represents the opening area of the throttle valve 5 which is read from a map of FIG. 3 as a value corresponding to the detected value of the throttle valve opening $\theta$TH. KAIC represents the opening area of the control valve 6 which is read from an ICMD-KAIC table of FIG. 4 as a value corresponding to the value ICMD of the driving current supplied to the solenoid 6*a* of the control valve 6 from the output circuit 9*d* of the ECU 9. Me represents the intervals of time at which TDC signal pulses are generated, which is measured by the ECU 9. The reason for obtaining the value Me is that, although the quantity of air passing the throttle valve 5 and the control valve 6 per unit time is constant so long as the sum of the opening areas of the valves 5 and 6 is constant, the quantity of air sucked into the engine per suction cycle of same varies with engine speed.

At step 9 a correction variable TIADJ is calculated by means of the following equations (7) and (8) wherein the values TIMP and TIDM obtained at steps 2 and 8, respectively, are substituted, each time a TDC signal pulse is generated.

$$TADJ = TIMP - TIDM \times KPA2 \quad (7)$$

$$TIADJ(n) = \frac{CIADJ}{256} \times TADJ + \frac{256 - CIADJ}{25} \times TIADJ(n-1) \quad (8)$$

where TADJ represents the difference between the basic fuel injection period obtained in the present loop by the SD method and that by the KMe method, and TIADJ(n) and TIADJ(n-1) are values of the correction variable TIADJ obtained in the present loop and in the immediately preceding loop, respectively. CIADJ is a constant which is suitably set to one of integers 1 through 256 corresponding to the cycle of pulsation in the intake pipe absolute pressure PBA, etc. KPA2 is an atmospheric pressure-dependent correction coefficient applicable to the KMe method which is obtained in the following manner:

When the ratio (PBA/PA') of intake pipe pressure PBA downstream of the throttling portion such as a throttle valve to intake pipe pressure PA' upstream of the throttling portion is smaller than the critical pressure ratio (=0.528), intake air passing the throttling portion forms a sonic flow. The flow rate Ga(g/sec) of intake air can be expressed as follows:

$$Ga = A \times C \times PA \times \sqrt{\left(\frac{2}{\kappa + 1}\right)^{\frac{\kappa+1}{\kappa-1}} \times \frac{g\kappa}{R(TAF + 273)}} \quad (9)$$

where A represents equivalent opening area ($mm^2$) of the throttling portion such as the throttle valve, C a correction coefficient having its value determined by configuration, etc. of the throttling portion, PA atmospheric pressure (PA nearly equals PA', mmHg), $\kappa$ the ratio of specific heat of air, R the gas constant of air, TAF the temperature (°C.) of intake air immediately upstream of the throttling portion, and g the gravitational acceleration ($m/sec^2$), respectively. So long as the intake air temperature TAF and the opening area A remain constant, the ratio of the flow rate of intake air Ga (in gravity or weight) under the actual atmospheric pressure PA to the flow rate of intake air Ga0 (in gravity or weight) under the standard atmospheric pressure PA0 can be expressed as follows:

$$\frac{Ga}{Ga0} = \frac{PA}{PA0}$$

If the quantity of fuel being supplied to the engine is varied at a rate equal to the above ratio of flow rate of intake air, the resulting air/fuel ratio is maintained at a constant value. Therefore, the flow rate Gf of fuel can be determined from the flow rate Gf0 of same under the standard atmospheric pressure PA0 (=760 mmHg), as expressed by the following equation:

$$Gf = Gf0 \times \frac{PA}{760}$$

Here, the atmospheric pressure-dependent correction coefficient KPA2 value can be theoretically expressed as follows:

$$KPA2 = \frac{PA}{760}$$

In practice, however, various errors resulting from configuration, etc. of the intake passage should be taken into account, and therefore the above equation can be expressed as follows:

$$KPA2 = 1 + CPA \times \frac{PA - 760}{760} \quad (10)$$

where CPA represents a calibration variable which is determined experimentally.

According to the equation (10), when the relationship PA<760 mmHg stands, the correction coefficient KPA2 value is smaller than 1.0. Since according to the KMe method, the quantity of intake air is determined solely from the equivalent opening area A of the throttling portion in the intake passage with reference to the standard atmospheric pressure PA0, it decreases in proportion as the atmospheric pressure PA decreases such as at a high altitude where the atmospheric pressure PA is lower than the standard atmospheric pressure PA0. Therefore, if the fuel quantity is set in dependence on the above opening area A, the resulting air/fuel mixture becomes richer, in a manner reverse to the SD method. However, such enriching of the mixture can be avoided by employing the above correction coefficient KPA2 value.

An error component of the value TADJ due to pulsation in the intake pipe absolute pressure PBA is eliminated by the averaging process effected by the equations (7) and (8) so that the value of the correction variable TIADJ obtained in step 9 represents only other errors such as error due to installation error of the throttle valve opening sensor and error due to clogging of the air cleaner. Since the correction variable TIADJ is calculated each time a TDC signal pulse is generated, the value of TIADJ has its value updated with the lapse of time to a value reflecting current conditions of clogging of the air cleaner, accumulation of carbon on the control valve and throttle valve, etc.

Reverting to FIG. 2, at step 10 a fuel injection period TIMI of the fuel injection valves 10 is calculated according to the KMe method by means of the following equation (11) wherein the values of the basic fuel injection period TIDM obtained at step 8, the atmospheric pressure-dependent correction coefficient KPA2, and the correction variable TIADJ obtained at step 9 are substituted:

$$TIMI = TIDM \times KPA2 + TIADJ \ldots \quad (11)$$

At step 11 it is determined whether or not the fuel injection period was determined by the KMe method in the immediately preceding loop (the mode in which the fuel injection period is determined by the KMe method will be hereinafter referred to as "the idle mode"), and if the answer is Yes, i.e. if the immediately preceding loop was in the idle mode, then the program proceeds to 17, skipping steps 12 through 16. If the answer to the question of step 11 is No, i.e. if the immediately preceding loop was not in the idle mode, then the program proceeds to step 12.

At steps 12 and 14 it is determined whether or not the fuel injection period TIMP determined by the SD method at step 2 and the fuel injection period TIMI determined by the KMe method at step 10 are substantially equal to each other. More particularly, step 12 determines whether or not the fuel injection period TIMP determined by the SD method is smaller than the product of the fuel injection period TIMI determined by the KMe method and a predetermined upper limit coefficient CH (e.g. 1.1), and step 14 determines whether or not the fuel injection period TIMP is greater than the product of the fuel injection period TIMI by the KMe method and a predetermined lower limit coefficient CL (e.g. 0.9). The predetermined upper and lower limit coefficients CH and CL are empirically obtained values which are optimal for smooth and stable engine operation.

Therefore, if the answers to the questions of steps 12 and 14 are both Yes, it is judged that the fuel injection period TIMP determined by the SD method and the fuel injection period TIMI determined by the KMe method are substantially equal to each other, and the program proceeds to step 17 where the fuel injection period T'OUT is set to the value of the fuel injection period TIMI by the KMe method.

Figure 5:
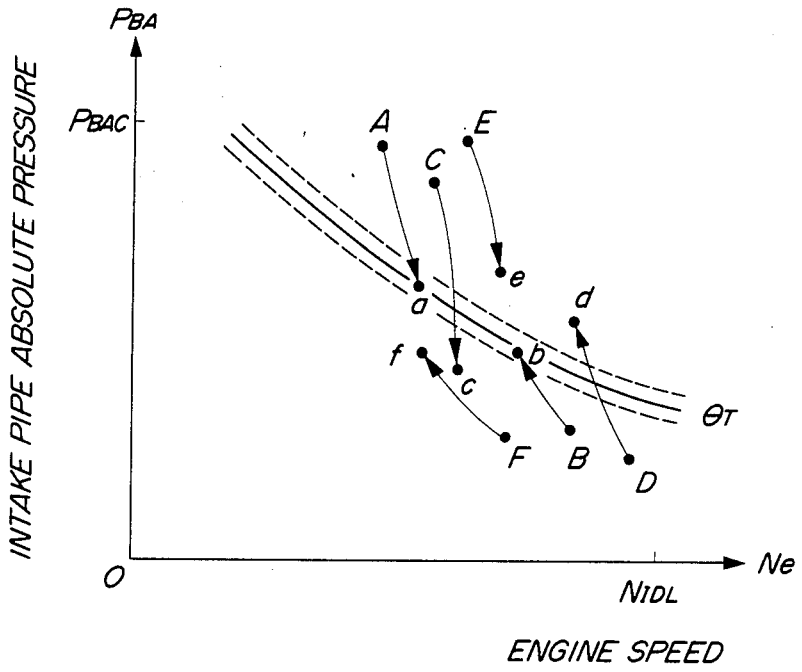
FIG. 5 is a graph showing various changes in engine operation which can occur during low load operation of the engine.

FIG. 5 is a diagram showing the relationship between results of determinations carried out at the steps 12 through 16 in FIG. 2 and various operating conditions of the engine, represented in terms of the intake pipe absolute pressure PBA and the engine speed Ne. Affirmative results obtained at the above steps 12 and 14 mean that, for instance, between execution of the immediately preceding loop and the present loop, the point of operation of the engine has shifted from the point A or B in the figure to the point a or b which can be regarded as substantially lying on a steady operating line of the engine along which the valve opening of the throttle valve is maintained at a value $\theta$T smaller than the aforementioned predetermined value $\theta$IDLH (in FIG. 5, the points a and b lie in a region defined between the two broken lines which are so set as to correspond to the aforementioned predetermined upper and lower limit coefficients CH, CL). Therefore, when such affirmative determinations are obtained, that is, when the answers to the questions at the steps 12 and 14 are both Yes, an abrupt change does not occur in the fuel supply quantity even if the manner of determining the fuel supply quantity is switched from the SD method to the KMe method, thus achieving smooth operation of the engine at changeover of the fuel supply control method.

Referring to FIG. 2, when the answer to the question at step 12 is No, the value of the aforementioned control variable Xn is set to 3 in the present loop (step 13), while when the answer to the question at step 14 is No, it is set to 2 (step 15). Next, at step 16, it is determined whether or not the difference between the value Xn−1 of the control variable assumed in the immediately preceding loop and the value Xn of same set in the present loop at step 13 or 15 is equal to 1. This determination is to determine whether or not the point of operation of the engine has shifted substantially across the steady operating line along which the throttle valve opening keeps the value $\theta$T detected in the present loop, between the immediately preceding loop and the present loop. That is, it is determined that the operating point of the engine has not shifted across the steady operating line along which the throttle valve opening keeps the value $\theta$T detected in the present loop, between the immediately preceding loop and the present loop (i.e. the operating lines E→e, F→f in FIG. 5), in the following cases: when the predetermined idling condition of the engine was not fulfilled in the immediately preceding loop (i.e. Xn−1=0, as set at step 6 in the immediately preceding loop) and the value of the control variable Xn is set to 3 in the present loop (step 13) as the result of a negative determination at step 12, when the determinations at step 12 provide negative answers both in the present loop and in the immediately preceding loop (i.e. Xn=Xn−1=3), or when the determinations at step 12 provide affirmative answers both in the present loop and in the immediately preceding loop and at the same time the determination at step 14 provides a negative answer (i.e. Xn=Xn−1=2). On such occasions, the answer to the question at step 16 becomes negative, and the SD method is continually applied to calculate the fuel injection period (the aforementioned step 7).

On the other hand, it is determined that the operating point of the engine has shifted across the steady operating line along which the throttle valve opening keeps the value $\theta$T detected in the present loop (i.e. the operating lines C - c, D - d in FIG. 5) between the immediately preceding loop and the present loop, in the following cases: when the answers to the questions at steps 12 and 14 were, respectively, yes and no in the immediately preceding loop (i.e. Xn−1=2), and at the same time the value of the control variable Xn is set to 3 in the present loop as the result of a negative determination at step 12, or when step 13 was executed in the immediately preceding loop (i.e. Xn−1=3), and at the same time step 15 is executed in the present loop (i.e. Xn=2). That is, on such occasions, the fuel injection period value calculated is substantially the same whichever of the SD method or the KMe method is employed, if the calculation is made at an intermediate time point between the immediately preceding loop and the present loop. Therefore, on such occasions, the fuel supply control should preferably be promptly switched to the KMe method. Accordingly, when the determination at step 16 provides an affirmative answer, calculation of the product term Ti×KPA×KTA is carried out according to the KMe method, at the aforementioned step 17.

Then, the resulting value of the product term Ti×KPA×KTA obtained at step 7 or 17 is applied to the aforementioned equation (1), and at the same time values of the correction coefficients and correction variables appearing in the equation (2) are calculated, to determine the fuel injection period TOUT for the fuel injection valves 10, at step 18, followed by termination of execution of the program.

The method of the present invention is not limited to the fuel injection quantity control for the fuel injection control system, described above, but it may be applied to other operation control means for controlling the engine, such as an ignition timing control system and an exhaust gas recirculation control system, so far as the operating amounts of these systems are determined in dependence on the intake air quantity.

What is claimed is:

1. A method of controlling an operating amount of an operation control means for controlling the operation of an internal combustion engine on the basis of a first desired operating amount determined in dependence on a value of a first engine operating parameter indicative of load conditions of said engine when said engine is operating in a predetermined low load condition, and on the basis of a second desired operating amount determined in dependence on a value of a second engine operating parameter indicative of load conditions of said engine when said engine is operating in an operating condition other than said predetermined low load condition, said method comprising the steps of: (1) when said engine has entered said predetermined low load condition from an operating condition other than said predetermined low load condition, (i) determining the difference between said first and second desired operating amounts of said operation control means, which are determined in dependence on the values of said first and second engine operating parameters, respectively, and obtaining a correction value of the operating amount of said operation control means on the basis of the determined difference, (ii) correcting the determined first desired operating amount by said correction value, (iii) comparing the corrected first desired operating amount with the determined second desired operating amount, and (iv) determining the desired operating amount of said operation control means in dependence on the determined second desired operating amount, from the time said engine has entered said predetermined low load condition to the time the corrected first desired operating amount becomes substantially equal to the determined second desired operating amount, even while said engine is actually operating in said predetermined low load condition; (2) determining the desired operating amount of said operation control means in dependence on the corrected first desired operating amount after the corrected first desired operating amount becomes substantially equal to the determined second desired operating amount until said engine enters an operating condition other than said predetermined low load condition; and (3) controlling the operating amount of said operation control means on the basis of the desired operating amount determined at said step (1)–(iv) or (2).

2. A method as claimed in claim 1, including steps of detecting an opening area of an intake passage of said engine, and detecting the rotational speed of said engine, and wherein said first desired operating amount is determined in dependence on the detected opening area of said intake passage and the detected engine rotational speed.

3. A method as claimed in claim 1, including steps of detecting pressure in an intake passage downstream of intake air quantity control means of said engine, and detecting the rotational speed of said engine, and wherein said second desired operating amount is determined in dependence on the detected pressure in said intake passage and the detected engine rotational speed.

4. A method as claimed in claim 1, wherein said method is executed in synchronism with generation of pulses of a predetermined control signal, and includes steps of determining a provisional correction value based on the difference between the determined first and second desired operating amounts each time a pulse of said predetermined control signal is generated, calculating an average value of values of said provisional correction value thus determined, and employing said average value as said correction value obtained at said step (1)–(i).

5. A method as claimed in claim 1, wherein said operation control means comprises fuel supply control means for controlling the quantity of fuel being supplied to said engine.

6. A method of electronically controlling the fuel supply to an internal combustion engine, wherein a required quantity of fuel is injected into said engine in synchronism with generation of pulses of a predetermined control signal indicative of predetermined crank angles of said engine, said engine having an intake passage, a throttle valve arranged across said intake passage, an auxiliary air passage opening into said intake passage at a location downstream of said throttle valve and communicating with the atmosphere, and a control valve arranged in said auxiliary air passage for controlling the quantity of supplementary air being supplied to said engine through said auxiliary air passage and said intake passage, said method comprising the steps of: (1) detecting a value of opening area corresponding to actual valve opening of said throttle valve; (2) detecting a value of opening area corresponding to actual valve opening of said control valve; (3) detecting an interval of time between generation of a preceding pulse of said predetermined control signal and generation of a present pulse of same; (4) detecting pressure in said intake passage downstream of said throttle valve; (5) determining whether or not said engine is operating in a predetermined low load condition; (6) determining values of first and second coefficients, respectively, in dependence on the detected value of opening area of said throttle valve obtained at said step (1) and the detected value of opening area of said control valve obtained at said step (2), when said engine is determined to be operating in said predetermined low load condition; (7) determining a first desired amount of fuel to be injected into said engine in dependence on a sum of the values of said first and second coefficients obtained at said step (6) and the detected value of interval of time between generation of a preceding pulse of said predetermined control signal and generation of a present pulse of same, obtained at said step (3); (8) when said engine is operating in an operating condition other than said predetermined low load condition, (i) determining a second desired fuel injection amount in dependence on at least the value of said pressure in said intake passage detected at said step (4), (ii) determining the difference between said first and second desired fuel injection amounts, and obtaining a correction value of the fuel injection amount on the basis of said difference, (iii) correcting the determined first desired fuel injection amount by the obtained correction value, (iv) comparing the corrected first desired fuel injection amount with the determined second desired fuel injection amount, and (v) determining the desired fuel injection amount in dependence on the determined second desired fuel injection amount from the time it is determined that said engine has entered said predetermined low load condition to the time the corrected first desired fuel injection amount becomes substantially equal to the determined second desired fuel injection amount, even while said engine is actually operating in said predetermined low load condition; (9) determining the desired fuel injection amount in dependence on the corrected first desired fuel injection amount after the corrected first desired fuel injection amount becomes substantially equal to the determined second desired fuel injection amount until said engine is detected to enter an operating condition other than said predetermined low load condition; and (10) controlling the quantity of fuel to be injected into said engine on the basis of the desired fuel injection amount determined at said step (8)–(v) or (9).

7. A method as claimed in claim 6, wherein, in said step (7), the desired fuel injection amount is determined in dependence value on a product obtained through multiplication of the sum of the determined values of said first and second coefficients by the detected value of interval of time between generation of a preceding pulse of said predetermined control signal and generation of a present pulse of same.

8. A method as claimed in claim 6, wherein said control valve comprises a linear solenoid type electromagnetic valve which has a valve opening area thereof controlled in proportion to driving current supplied thereto.

9. A method as claimed in claim 6, wherein said method is executed in synchronism with generation of pulses of a predetermined control signal, and includes steps of determining a provisional correction value based on the difference between the determined first and second desired fuel injection amounts each time a pulse of said predetermined control signal is generated, calculating an average value of values of said provisional correction value thus determined, and employing said average value as said correction value obtained at said step (8)-(ii).

10. A method as claimed in claim 6, wherein said step (5) comprises the steps of detecting a value of pressure in said intake passage upstream of said throttle valve, setting a predetermined reference pressure value in dependence on the detected value of pressure in said intake passage upstream of said throttle valve, comparing said predetermined reference pressure value with the value of pressure in said intake passage downstream of said throttle valve detected at said step (4), and determining that said engine is operating in said predetermined low load condition when the detected value of pressure in said intake passage downstream of said throttle valve shows a value indicative of lower engine load with respect to said predetermined reference pressure value.

* * * * *